US005883560A

United States Patent [19]

Nakamura et al.

[11] Patent Number: 5,883,560

[45] Date of Patent: Mar. 16, 1999

[54] FUSIBLE MEMBER OF A FUSIBLE LINK ELEMENT

[75] Inventors: Goro Nakamura; Kenji Muramatsu, both of Shizuoka, Japan

[73] Assignee: Yazaki Corporation, Tokyo, Japan

[21] Appl. No.: 788,078

[22] Filed: Jan. 22, 1997

[30] Foreign Application Priority Data

Jan. 29, 1996 [JP] Japan ..... 8-013011

[51] Int. Cl.[6] ..... H01H 85/04

[52] U.S. Cl. ..... 337/160; 337/198; 337/152; 337/186; 439/621

[58] Field of Search ..... 337/166, 186, 337/296, 160, 158, 159, 161, 162, 163, 164, 165, 295, 225, 280

[56] References Cited

U.S. PATENT DOCUMENTS

| | | | |
|---|---|---|---|
| 4,058,784 | 11/1977 | Gaia | 337/164 |
| 4,219,795 | 8/1980 | Panaro et al. | 337/296 |
| 5,252,942 | 10/1993 | Gurevich | 337/163 |
| 5,262,751 | 11/1993 | Kudo et al. | 337/296 |
| 5,528,213 | 6/1996 | Kondo et al. | 337/160 |

*Primary Examiner*—Lynn D. Feild
*Assistant Examiner*—Anatoly Vortman
*Attorney, Agent, or Firm*—Sughrue, Mion, Zinn, Macpeak & Seas, PLLC

[57] ABSTRACT

A fusible member of a fusible link element used as a large-current fuse comprises a sealed box-shaped structure having a pouring hole through an upper wall thereof. Molten tin is poured into this sealed box-shaped structure through the pouring hole, and is solidified to be integrated with the sealed box-shaped structure.

10 Claims, 3 Drawing Sheets

FUSIBLE MEMBER OF A FUSIBLE LINK ELEMENT

BACKGROUND OF THE INVENTION

1. Field of the Invention

This invention relates to a fusible member of a fusible link element used as a large-current fuse.

2. Description of the Related Art

FIG. 8 shows an overall construction of one conventional fusible link element 1 of a fuse structure used in a connector for connecting a wire harness in an automobile or the like, and this fusible link element includes a pair of opposed female terminal portions 2, and a retaining piece portion 3, stamped and directed upwardly, is formed on an outer surface of each female terminal portion 2. A relatively-wide base portion 4 extends upwardly from an outer wall of each female terminal portion 2, and a bent portion 5 extends from the base portion 4. A laterally-extending portion 6 is formed at a distal end portion of one of the bent portions 5, and a tin alloy chip 7, having a narrow width corresponding to a predetermined melting capacity, is provided adjacent to the laterally-extending portion 5. Upwardly-projecting portions 9 are forcibly deformed to embrace the tin alloy chip 7 to provide a fusible member 8. Thereafter, the tin alloy chip 7 is melted or fused to the fusible member so as to stabilize melting characteristics of the fuse.

In the above fusible link element, the upwardly-projecting portions 9 are forcibly deformed by pressing to hold the tin alloy chip 7. A high-precision technique is required for securing the soft tin alloy chip to the fusible member during the pressing of the fusible member. And besides, in order to stabilize the melting characteristics of the fuse, the tin alloy chip is heated to a certain temperature, and then is fused to the fusible member. In this fusing step, the tin alloy chip must be prevented from being overheated so that the tin alloy chip will not flow away from the fusible member, and therefore a relatively high technique is required for controlling this fusion temperature, and therefore in the manufacture of the fusible link element, such a fusion step, together with the pressing step, greatly lowers the productivity of the fusible link element. The tin alloy portion thus formed is exposed at its surface to the air, and therefore is susceptible to oxidation.

SUMMARY OF THE INVENTION

It is an object of this invention to provide a fusible member of a fusible link element in which a tin alloy portion of the fusible member can be easily formed, and is prevented from being flowed away upon fusion, and also is prevented from oxidation at its surface, thereby enhancing the productivity.

The above object has been achieved by a fusible structure of a fusible link element used as a large-current fuse, comprising; a sealed box-shaped structure, having a pouring hole formed through an upper wall thereof, is provided on a distal end portion of one of bent portions of the fusible link element; and molten tin alloy is poured into the sealed box-shaped structure through the pouring hole, and the poured tin alloy is solidified to be integrated with the sealed box-shaped structure.

The fusible structure of the fusible link element is formed by pouring the molten tin alloy into the sealed box-shaped structure through the pouring hole, and then by solidifying the poured tin alloy to be integrated with the sealed box-shaped structure. The tin alloy is retained in the sealed box-shaped structure, and therefore will not flow away as experienced in the conventional construction upon fusion of the tin alloy. And besides, the tin alloy is held within the sealed box-shaped structure, and is not exposed directly to the outside air, and therefore is prevented from oxidation at its surface.

In one preferred form of the invention, the sealed box-shaped structure comprises a preformed box, and the preformed box is mounted on the distal end portion of the one bent portion of the fusible link element. Thus, the separate sealed box-shaped structure is secured to this distal end portion, and therefore the step of pouring the molten tin alloy, which radiates heat to the surroundings, can be separate from the other steps, and this enhances the efficiency of the operation.

In another preferred form of the invention, the sealed box-shaped structure comprises a preformed rectangular bent piece, and a pair of wing-like piece portions formed integrally at the distal end portion of the one bent portion, and the pair of wing-like piece portions are bent upwardly, and the rectangular bent piece is fitted in a space between the thus bent wing-like piece portions, so that the sealed box-shaped structure is assembled in a unitary manner. By thus assembling the sealed box-shaped structure, the step of pouring the molten tin alloy, which radiates heat to the surroundings, can be carried out at a different site after the assembling of the fusible link element is finished as in the above preferred embodiment, and therefore the efficiency of the operation is enhanced.

DETAILED DESCRIPTION OF THE PREFERRED EMBODIMENTS

One preferred embodiment of a fusible member of a fusible link element of the present invention will now be described in detail with reference to FIG. 1 which is an exploded, perspective view of a fuse structure incorporating the fusible link element.

Figure 1:
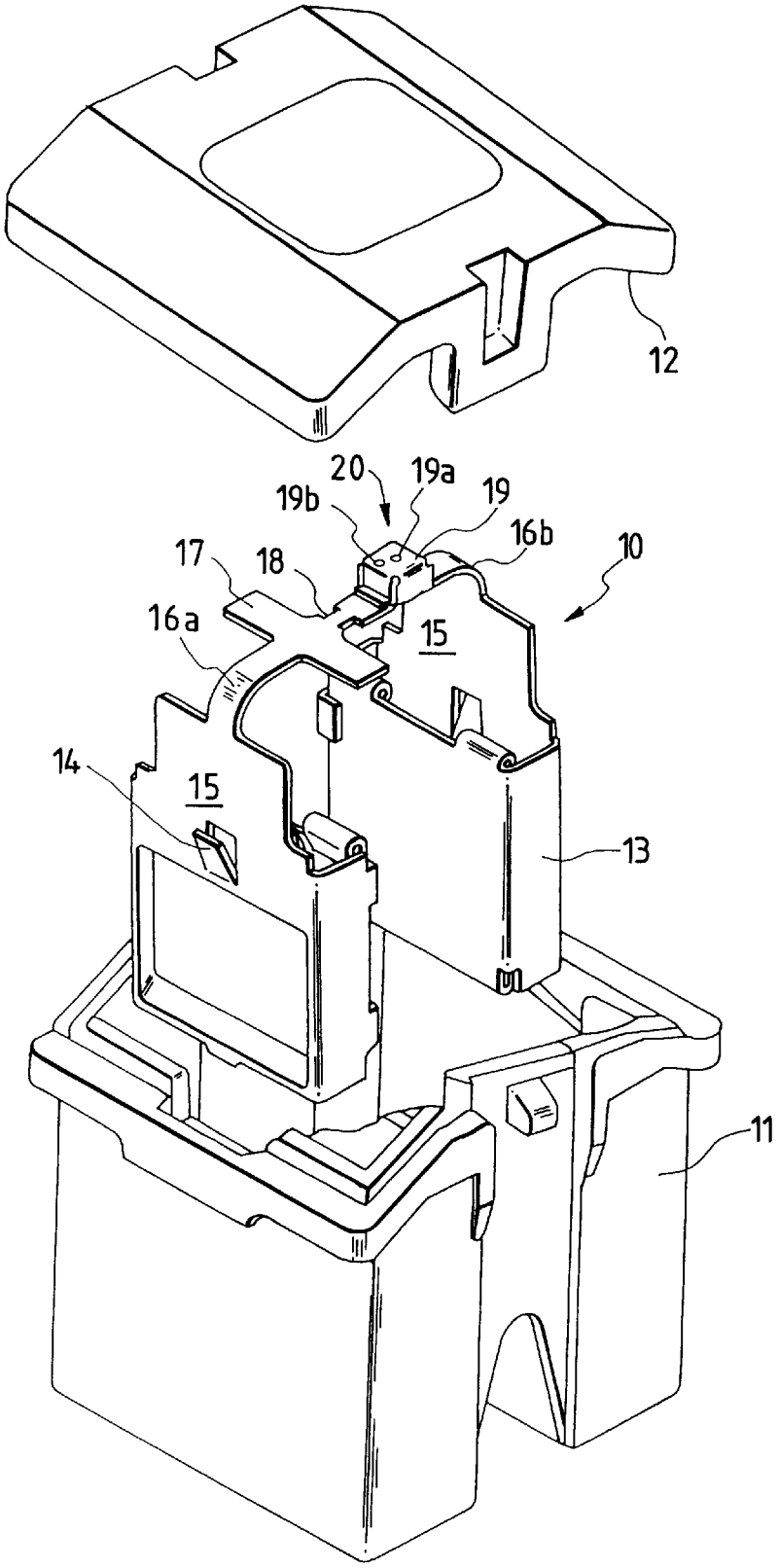
FIG. 1 is an exploded, perspective view of a fuse structure using a fusible member of a fusible link element according to the present invention.

In FIG. 1, the fuse structure, used in a connector for connecting a wire harness in an automobile or the like, comprises the fusible link element 10, a housing 11 for housing this fusible link element, and a housing cover 12 for sealingly closing an upper open top of the housing 11.

The fusible link element 10 of the fuse structure includes a pair of opposed female terminal portions 13, and a retaining piece portion 14, stamped and directed obliquely upwardly, is formed on an outer surface of each female terminal portion 13. A relatively-wide base portion 15 extends upwardly from an outer wall of each female terminal portion 13, and a pair of symmetrically-arranged bent portions 16*a* and 16*b* extend respectively from the base portions 15. A laterally-extending, wing-like radiating plate 17 is formed at a distal end portion of one bent portion 16*a*. A melting portion 18, having a narrow width corresponding to a predetermined melting capacity, is formed at a distal end portion of the one bent portion 16*a* disposed immediately adjacent to a distal end of the other bent portion 16*b*. A sealed box-shaped structure 19 is formed integrally on the distal end portion of the other bent portion 16*b*, and a tin alloy is poured into this sealed box-shaped structure 19 to form a fusible member 20. The tin alloy, thus poured in the molten state, is cooled in order to stabilize melting characteristics of the fuse, and is solidified within the sealed box-shaped structure 19 to be integrated therewith.

The sealed box-shaped structure 19 has a pouring hole 19*a* for pouring the molten tin alloy therethrough, and a vent hole 19*b*.

Figure 2:
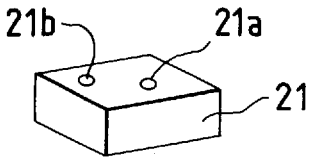
FIG. 2 is a schematic view showing a box forming one example of a sealed box-shaped structure.
Figure 3:
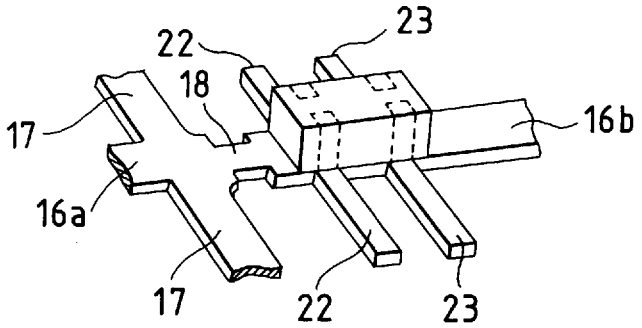
FIG. 3 is a schematic view showing a method of retaining the box of FIG. 2 on a distal end portion of a bent portion of the fusible link element.
Figure 4:
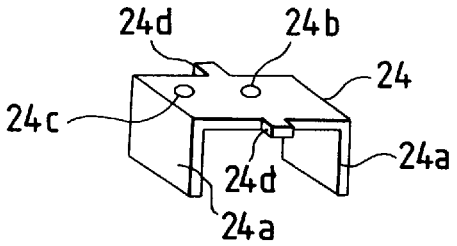
FIG. 4 is a schematic view showing a bent piece forming part of a box of another example of a sealed box-shaped structure.
Figure 5:
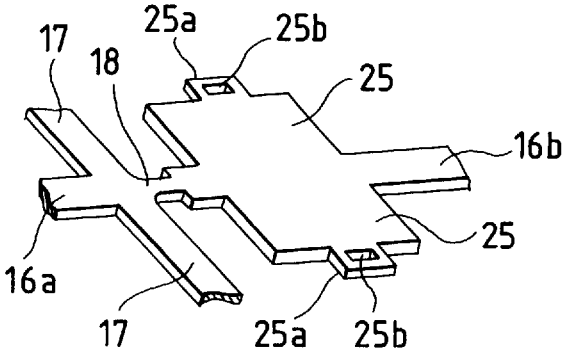
FIG. 5 is a schematic view showing a distal end portion of a bent portion of the fusible link element having wing-like piece portions which form part of the box of the sealed box-shaped structure of FIG. 4.

In one example of such sealed box-shaped structure 19, as shown in FIG. 2, a preformed box 21, having a pouring hole 21*a* and a vent hole 21*b*, is mounted on the distal end portion of the other bent portion 16*b* as in the fusible link element 10 of FIG. 1. Two pairs of claws 22 and 23 are formed integrally on this distal end portion by blanking, each pair of claws extending perpendicularly from opposite side edges of the distal end portion, respectively, as shown in FIG. 3. The claws 22 and 23 are bent to embrace the box 21, thereby fixing the box 21 on the distal end portion of the other bent portion 16*b*. These claws do not always need to be provided in pairs, but may be arranged in any suitable form in so far as they can properly embrace or retain the separate box 21.

Figure 6:
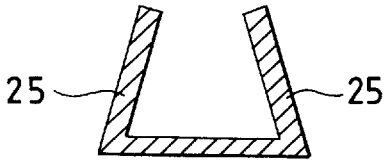
FIG. 6 is a cross-sectional view showing the upwardly-bent wing-like piece portions formed on the distal end portion of FIG. 5.
Figure 7:
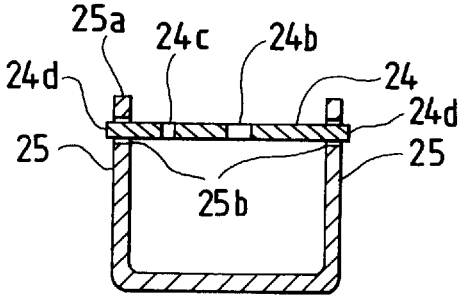
FIG. 7 is a schematic cross-sectional view showing a condition in which the bent piece of FIG. 4 is fitted in a space between the wing-like piece portions.
Figure 8:
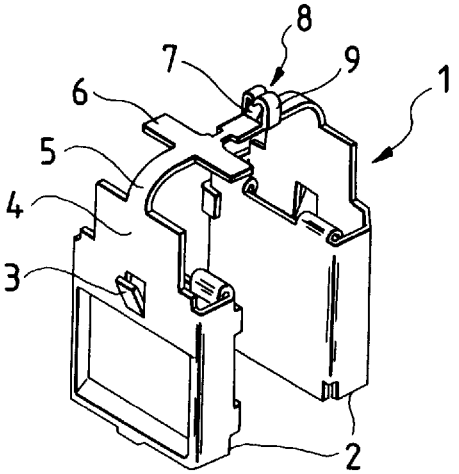
FIG. 8 RELATED ART
FIG. 8 is a schematic perspective view showing a fusible piece portion of a conventional fusible link element.

In another example of the sealed box-shaped structure 19, as shown in FIGS. 4 to 7, a bent piece 24 of a rectangular shape (FIG. 4), having a pair of legs 24*a*, a pouring hole 24*b* and a vent hole 24*c*, is preformed, and a pair of wing-like piece portions 25 (FIG. 5) extend perpendicularly from opposite side edges of the distal end portion of the other bent portion 16*b*, respectively. The wing-like piece portions 25 are bent until they are directed upwardly, and are inclined inwardly as shown in FIG. 6, so that a space, defined by the pair of the thus bent wing-like piece portions 25 and the distal end portion of the bent portion 16*b*, assumes a generally rectangular cross-section. The rectangular bent piece 24 is inserted or fitted into the space between the thus bent wing-like piece portions 25, so that a box structure, having a square cross-section as shown in FIG. 7, is formed. In this sealed box-shaped structure 19, the rectangular bent piece 24 is retained and held in position by the resiliency of the wing-like piece portions 25.

In order to increase the mechanical strength of the sealed box-shaped structure 19, a pair of projections 24*d* are formed on and project laterally from central portions of opposite side edges of an upper wall of the rectangular bent piece 24, respectively, and a pair of retaining portions 25*a* are formed on and project from central portions of outer edges of the wing-like piece portions 25, respectively. The pair of retaining portions 25*a* have small holes 25*b*, respectively, into which the pair of projections 24*d* are fitted, respectively. In an assembled condition of the box structure, the projections 24*d* are engaged respectively with the retaining portions 25*a* in a manner shown in FIG. 7 which shows a transverse cross-section of the box structure.

In the fusible link element 10 having either of the above sealed box-shaped structures 19, molten tin alloy is poured into the sealed box-like structure 19 through the pouring hole 19*a*, 21*a*, 24*b*. For pouring the molten tin alloy through this pouring hole, a dispenser (not shown) with a heater is used.

The present invention is not to be limited to the above embodiments, and for example the sealed box-like structure 19 can be formed on the distal end portion of the one bent portion 6*a*.

As described above, in the present invention, there is provided the fusible member of the fusible link element used as a large-current fuse, in which the sealed box-shaped structure, having the pouring hole formed through the upper wall thereof, is provided on the distal end portion of one of the bent portions of the fusible link element, and the molten tin alloy is poured into the sealed box-shaped structure through the pouring hole, and the poured tin alloy is solidified to be integrated with the sealed box-shaped structure. Therefore, there can be provided the fusible member of the fusible link element, in which the tin portion of the fusible member can be easily formed, and the molten (or liquid-state) tin alloy, which is in an unstable condition, is filled and sealed in the box, and is prevented from flowing away upon fusion, and also the surface of the tin alloy is prevented from oxidation. A change of the melting characteristics with time is avoided, and there is achieved an advantage that the expected performance can be maintained for a long period of time.

And besides, in contrast with the conventional construction, the pressing operation (which requires much time and labor) required for securing the tin alloy chip to the fusible piece portion, as well as the temperature control required when fusing the tin alloy, are not needed, and the heating operation can be effected at a separate step, and therefore the efficiency of the operation, that is, the productivity, is enhanced.

What is claimed is:

1. A fusible member of a fusible link element used as a large-current fuse, comprising:

a sealed box-structure provided on one part of the fusible link element; and molten tin alloy poured into said sealed box-shaped structure and solidified to be integrated with said sealed box-shaped structure.

wherein said sealed box-shaped structure comprises: a preformed rectangular bent piece; and a pair of wing-like piece portions formed integrally at a distal end portion of one bent portion of the fusible link element, and said pair of wing-like piece portions are bent upwardly and said rectangular bent piece is fitted in a space betwen said pair of bent wing-like piece portions so as to assemble said sealed box-shaped structure.

2. A fusible member of a fusible link element used as a large current fuse, comprising:

a sealed box-structure provided on one part of the fusible link element; and molten tin alloy poured into said sealed box-shaped structure and solidified to be integrated with said sealed box-shaped structure, wherein a pouring hole through which said molten tin alloy is poured is provided in said sealed box-shaped structure.

3. The fusible member of a fusible link element according to claim 2, wherein a vent hole is provided in said sealed box-shaped structure.

4. A fusible link element used as a large-current fuse, comprising:

a pair of female terminals;

a pair of bent portions extended from said pair of female terminals and connected each other; and a fusible member formed in such a manner that a sealed space is formed on said bent portion and molten alloy is poured into said sealed space and solidified in said sealed space so as to be fused to one of said pair of bent portions.

5. The fusible link element according to claim 4, wherein said alloy is tin alloy.

6. The fusible link element according to claim 5, wherein said sealed space is formed as a sealed box-shaped structure.

7. The fusible link -element according to claim 6, wherein said sealed box-shaped structure is a preformed box, and said preformed box is mounted on the one part of the fusible link element.

8. The fusible link element according to claim 6, wherein said sealed box-shaped structure comprises: a preformed rectangular bent piece; and a pair of wing-like piece portions formed integrally at a distal end portion of said bent portion, and said pair of wing-like piece portions are bent upwardly and said rectangular bent piece is fitted in a space between said pair of bent wing-like piece portions so as to assemble said sealed box-shaped structure.

9. The fusible link element according to claim 6, wherein a pouring hole through which said molten tin alloy is poured is provided in said sealed box-shaped structure.

10. The fusible link element according to claim 9, wherein a vent hole is provided in said sealed box-shaped structure.

* * * * *